US008495873B2

(12) United States Patent
Foster

(10) Patent No.: US 8,495,873 B2
(45) Date of Patent: Jul. 30, 2013

(54) LIQUID COOLED STIRLING ENGINE WITH A SEGMENTED ROTARY DISPLACER

(75) Inventor: Phillip R. Foster, Denton, TX (US)

(73) Assignee: University of North Texas, Denton, TX (US)

( * ) Notice: Subject to any disclaimer, the term of this patent is extended or adjusted under 35 U.S.C. 154(b) by 285 days.

(21) Appl. No.: 12/884,089

(22) Filed: Sep. 16, 2010

(65) Prior Publication Data

US 2011/0061378 A1 Mar. 17, 2011

Related U.S. Application Data

(60) Provisional application No. 61/243,011, filed on Sep. 16, 2009.

(51) Int. Cl.
*F01B 29/10* (2006.01)
*F02G 1/04* (2006.01)

(52) U.S. Cl.
USPC ..... 60/519; 60/517

(58) Field of Classification Search
USPC ..... 60/516–526
See application file for complete search history.

(56) References Cited

U.S. PATENT DOCUMENTS

| | | | | |
|---|---|---|---|---|
| 3,958,422 | A * | 5/1976 | Kelly | 60/525 |
| 4,372,115 | A * | 2/1983 | Rauch | 60/520 |
| 4,458,489 | A | 7/1984 | Walsh | |
| 5,907,201 | A * | 5/1999 | Hiterer et al. | 310/30 |
| 8,212,445 | B2 * | 7/2012 | Ritchey | 310/112 |
| 2003/0000210 | A1 * | 1/2003 | Gross et al. | 60/517 |
| 2004/0194461 | A1 | 10/2004 | Yamamoto | |
| 2005/0060996 | A1 * | 3/2005 | Pellizzari et al. | 60/517 |
| 2006/0185825 | A1 * | 8/2006 | Chen et al. | 165/104.21 |
| 2007/0193266 | A1 * | 8/2007 | McConaghy | 60/520 |
| 2008/0148754 | A1 * | 6/2008 | Snytsar | 62/259.2 |
| 2008/0282695 | A1 * | 11/2008 | Sollie et al. | 60/520 |
| 2010/0064681 | A1 * | 3/2010 | Yegge | 60/520 |
| 2010/0162697 | A1 * | 7/2010 | Fleck | 60/519 |

* cited by examiner

*Primary Examiner* — Thomas Denion
*Assistant Examiner* — Brian Inacay
(74) *Attorney, Agent, or Firm* — Chainey P. Singleton; Edwin S. Flores; Chalker Flores, LLP

(57) ABSTRACT

The present invention provides a Stirling engine employing a segmented, rotary displacer for producing mechanical energy from a heat source. The engine includes a rotor shaft rotatably positioned in the interior toroidal cavity with a segmented displacer mounted to the rotor shaft within the interior toroidal cavity.

17 Claims, 20 Drawing Sheets

LIQUID COOLED STIRLING ENGINE WITH A SEGMENTED ROTARY DISPLACER

CROSS-REFERENCE TO RELATED APPLICATIONS

This application claims priority to U.S. Provisional Application Ser. No. 61/243,011, filed Sep. 16, 2009, the contents of which is incorporated by reference herein in its entirety.

TECHNICAL FIELD OF THE INVENTION

The present invention relates in general to the field of Stirling engines, and more particularly to the design and fabrication of a novel Stirling engine with augmented heat transfer due to the profile and segmented design of the rotary displacer.

STATEMENT OF FEDERALLY FUNDED RESEARCH

None

INCORPORATION-BY-REFERENCE OF MATERIALS FILED ON COMPACT DISC

None.

BACKGROUND OF THE INVENTION

Without limiting the scope of the invention, its background is described in connection with the different displacer piston designs for Stirling engines and related devices.

U.S. Pat. No. 4,458,489 issued to Walsh (the '489 patent) describes a new and improved resonant free-piston Stirling engine and method of operation employing a novel virtual rod displacer. According to the '489 patent a rod is secured to and reciprocally moves with the displacer within the Stirling engine and has a rod piston area formed on the end of the rod remote from the displacer with the rod piston area also being subjected to the working gas periodic pressure wave. Suitable support bearings are designed within the Stirling engine housing for reciprocatingly supporting the displacer and rod assembly within the Stirling engine with a set of opposed acting gas springs being provided to act on the displacer end and rod assembly area end of the displacer and rod assembly. One end of the displacer is designed to have a greater effective area acted upon by the gas contained within the engine than the effective area of the opposite end whereby the unbalanced areas of the opposing displacer ends create a differential force when acted upon by a periodic pressure wave, causing reciprocating motion of the displacer and virtual rod assembly. In the preferred embodiment a displacer electrodynamic machine is provided for selectively driving or loading the displacer and rod assembly to thereby control the stroke and/or phase angle at which the displacer and rod assembly move relative to the output power piston or work member.

United States Patent Application No. 20070193266 (McConaghy, 2007) describes a Stirling engine machine comprises a plurality of opposing pairs of cylinder modules. Each cylinder module comprises a first end, a second end, and a piston moveable along a longitudinal axis extending between the first and second ends. The opposing pairs of cylinder modules have axes that are substantially aligned with each other such that movement of the pistons of opposing pairs substantially dynamically cancel. The opposing pairs of cylinder modules have first ends that are in proximity to each other.

United States Patent Application No. 20040194461 (Yamamato, 2003) discloses a Stirling engine comprising: a displacer unit having displacer cylinders, displacers slidably arranged in the chambers of the displacer cylinders, expansion chambers and contraction chambers into which, and from which, the operation gas flows with the operation of the displacers; and a power piston unit having a power cylinder having an operation chamber communicated with either the expansion chamber or the contraction chamber of the displacer unit, and a power piston slidably arranged in the power cylinder; wherein the displacer cylinders of the displacer unit are equipped with a heating wall surrounding a heat source and cooling walls forming a plurality of cylinder chambers surrounding the heating wall; and the displacers of the displacer unit are slidably arranged in the plurality of cylinder chambers in the directions to approach the heat source and to separate away from the heat source.

SUMMARY OF THE INVENTION

The present invention provides a Stirling engine employing a segmented, rotary displacer for producing mechanical energy from a heat source. The engine includes an engine housing having a hot displacer side and a cold displacer side separated by an insulating seal, and an interior toroidal cavity to receive a gas; a rotor shaft rotatably positioned in the interior toroidal cavity; a segmented displacer mounted to the rotor shaft within the interior toroidal cavity, wherein the segmented displacer has 3 or more displacement segments wherein each of the 3 or more displacement segments individually comprise a chamber portion; one or more hot ports located on the hot displacer side, wherein the rotation of the segmented displacer moves the chamber portion to direct a hot gas to the one or more hot ports; one or more cold ports located on the cold displacer side, wherein the rotation of the segmented displacer moves the chamber portion to direct a cold gas to the one or more cold ports; and a hot side of a power piston cylinder connected to the one or more hot ports by a hot cross-over tube, wherein a power piston in the power piston cylinder moves outwards by the hot gas expanding.

The present invention also includes a multi-cylinder Stirling rotary engine having an engine housing with 2 or more cylinders, wherein each of the 2 or more cylinders comprise a hot displacer side and a cold displacer side separated by an insulating seal, and an interior toroidal cavity to receive a gas; a rotor shaft rotatably positioned in the interior toroidal cavity; a segmented displacer mounted to the rotor shaft within the interior toroidal cavity, wherein the segmented displacer has 3 or more displacement segments individually have a chamber portion; one or more hot ports located on the hot displacer side, wherein the rotation of the segmented displacer moves the chamber portion to direct a hot gas to the one or more hot ports; one or more cold ports located on the cold displacer side, wherein the rotation of the segmented displacer moves the chamber portion to direct a cold gas to the one or more cold ports; and a hot side of a power piston cylinder connected to the one or more hot ports by a hot cross-over tube, wherein a power piston in the power piston cylinder moves outwards by the hot gas expanding; and a belt to connect the segmented rotary displacer shafts of the 2 or more cylinders.

The present invention includes a method of making a multi-cylinder Stirling rotary engine by providing an engine housing having 2 or more cylinders wherein each of the 2 or more cylinders comprise a hot displacer side and a cold displacer side separated by an insulating seal, one or more hot ports located on the hot displacer side, one or more cold ports located on the cold displacer side and an interior toroidal cavity to receive a gas; positioning rotatably a rotor shaft in the interior toroidal cavity; connecting a segmented displacer comprising to the rotor shaft, wherein the segmented displacer comprises 3 or more displacement segments individually having a chamber portion that fills a portion of the toroidal cavity to direct the movement of a gas, wherein the rotation of the segmented displacer moves the chamber portion to direct a hot gas to the one or more hot ports and to direct a cold gas to the one or more cold ports; connecting a power piston cylinder housing a power piston to the one or more hot ports by a hot cross-over tube, wherein the power piston in the power piston cylinder moves outwards by the hot gas expanding; and a belt to connect the rotor shaft of the 2 or more cylinders.

BRIEF DESCRIPTION OF THE DRAWINGS

For a more complete understanding of the features and advantages of the present invention, reference is now made to the detailed description of the invention along with the accompanying figures and in which:

FIG. 2 is a picture showing the assembly sequence for the segmented rotary displacer.

DETAILED DESCRIPTION OF THE INVENTION

While the making and using of various embodiments of the present invention are discussed in detail below, it should be appreciated that the present invention provides many applicable inventive concepts that can be embodied in a wide variety of specific contexts. The specific embodiments discussed herein are merely illustrative of specific ways to make and use the invention and do not delimit the scope of the invention.

To facilitate the understanding of this invention, a number of terms are defined below. Terms defined herein have meanings as commonly understood by a person of ordinary skill in the areas relevant to the present invention. Terms such as "a", "an" and "the" are not intended to refer to only a singular entity, but include the general class of which a specific example may be used for illustration. The terminology herein is used to describe specific embodiments of the invention, but their usage does not delimit the invention, except as outlined in the claims.

Figure 1A:
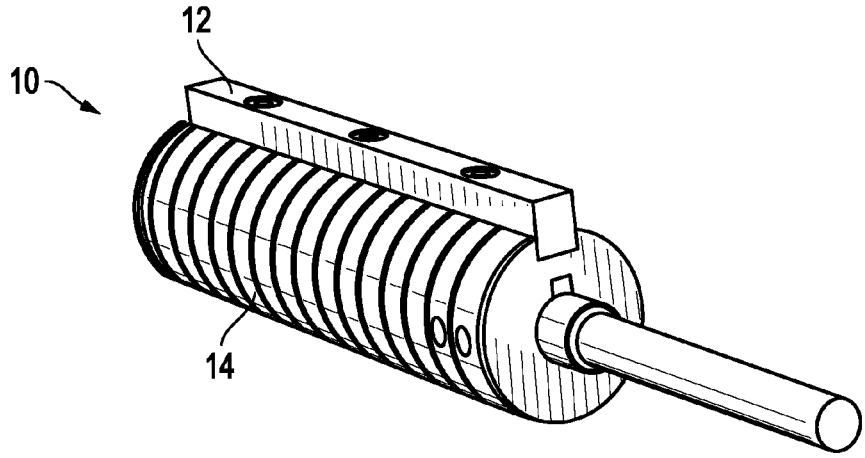
FIG. 1A shows the segment carrier sub-assembly.
Figure 1B:
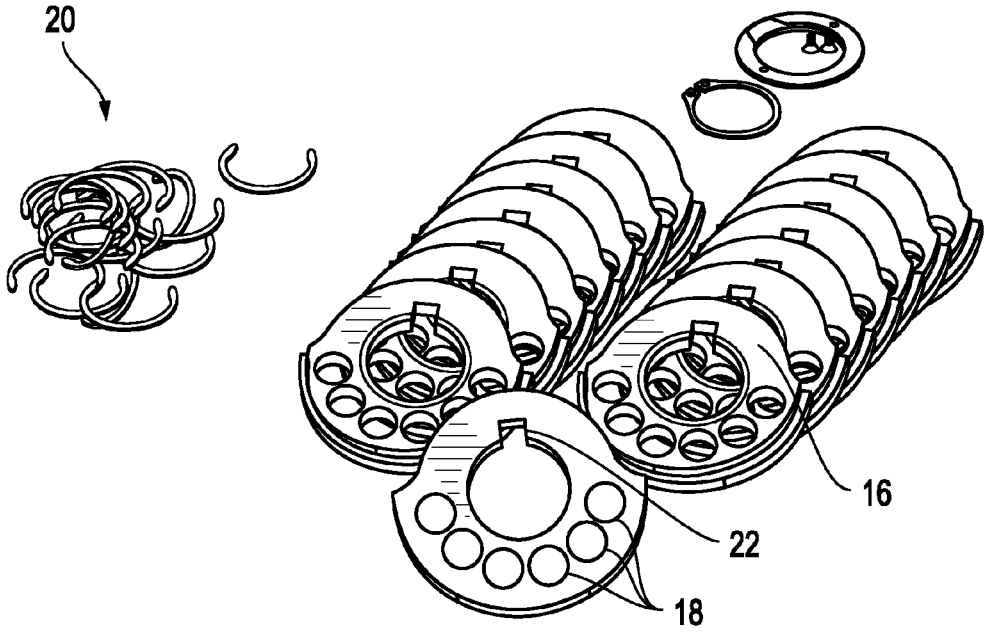
FIG. 1B shows all the component parts of the segmented rotary displacer. These include the segment carrier sub-assembly, the segments themselves, the segment fillers (6 of 96) and the external retaining rings.

As used herein the term rotor, segment or displacer segment may be used interchangeably and refer to the same component as seen in FIG. 1B and may be used interchangeably.

The present invention describes the design and fabrication of a Stirling engine with a unique profile and segmented design of the rotary displacer and the corresponding hot and cold halves of the surrounding displacer chamber. The displacer profile and segmented design augments heat transfer. The segmented displacer and displacer housing feature two novel rotary valves which direct the flow of the working gas to and from the power piston. The engine design of the present invention makes it flexible with regard to configuring multi-cylinder applications. This added flexibility of the present invention makes it unique or novel.

The engine described in the present invention is intended to power an electric generator for the purpose of recharging batteries. Such an engine-generator unit could be located on-board an electric powered vehicle or at a stationary installation where it could function as an individual vehicle or fleet recharger. Stationary applications extend beyond vehicular needs. In some embodiments, the present invention is used in conjunction with a generator while other embodiments are used alone.

The "existing technology" is represented mainly by conventional internal combustion engines. Stirling engines, in general, have the following advantages over internal combustion engines: they are more efficient; they are more reliable; they utilize a range of energy sources, many of which are renewable and/or less polluting (traditional combustion of a variety of fuels, biomass, concentrated solar energy, nuclear, geothermal, industrial process waste heat, etc.); they are quiet with respect to audible noise and radio interference. These advantages of Stirling engines are commonly cited in the literature.

The engine of the present invention is designed so that multiple units can be teamed together using a single timing belt (comparable to the serpentine belt which drives various accessories under the hood of an automobile). As such, it would be both easy and cost efficient to customize the number of "cylinders" available for a given application. This represents an advantage over the popular but more complex Gamma Stirlings. Commercial Gamma engines are multi cylinder, but the cylinders are machined or cast in-block, in a manner conceptually similar to an automobile engine. This increases their cost and weight and it also decreases their flexibility in terms of the number of cylinders available for varying applications, i.e., addition or subtraction of cylinders requires new castings. The engine of the present invention is superior to Alpha and Beta Stirling designs also, with regard to the minimum number of required moving parts per power cylinder.

Robert Stirling invented and patented the first Stirling engine in 1816. Additional patents were awarded for improvements during the ensuing years. The early applications of this invention were primarily industrial in nature, e.g., pumping water, driving machinery, etc. Developmental effort, at this time, was fueled by the high incidence of steam boiler explosions and their attendant loss of life. Eventually, refinements in steel manufacture and legislation alleviated the fear of such explosions and steam assumed the role of prime mover throughout the Industrial Revolution in the United States. Consequently, interest in the Stirling engine waned and development stagnated until the early 1940s. The desirability of a reliable, low cost engine generator for rural areas devoid of power grids became the motivational force for the Phillips Company to invest in Stirling research and development. From this time to the present day there has been continuous, although varying, levels of interest in the Stirling cycle. Findings have been promising. The science of thermodynamics enhanced understanding of the cycle; new materials increased reliability and power output. Engine configurations i.e., Alpha, Beta and Gamma, were established to mechanically classify Stirling engines. Pressurization and regeneration became characteristic of successful commercial applications. Today, Stirling engines and/or engine-generator sets can be found in agricultural communities, deep sea submersibles, hybrid automobiles, etc. The technology is under consideration for powering deep space exploration.

Three novel aspects of the engine of the present invention include (i) the segmented displacer with a stepped or radial profile, also apparent in the design of the displacer housing; (ii) the rotary valve mechanism; and (iii) a modular, multi-cylinder capability.

Figure 2A:
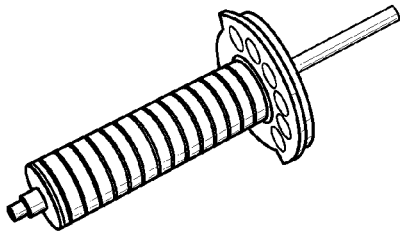
FIG. 2A is the displacer carrier sub-assembly with the first segment or rotor (#1/2), complete with six segment fillers, in place.
Figure 2B:
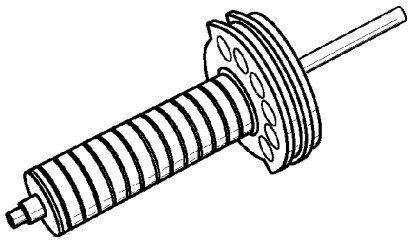
FIGS. 2B is an image that depicts sequential segments secured in place along the carrier sub-assembly utilizing additional retaining rings.
Figure 3:
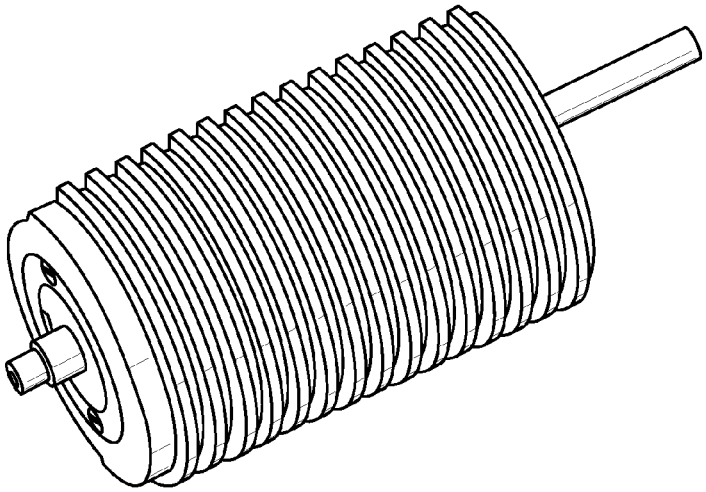
FIG. 3 shows a completed segmented rotary displacer.

FIGS. 1-3 display: the individual components that comprise the segmented displacer, the assembly sequence for the displacer, and the fully assembled segmented displacer.

FIG. 1A shows the carrier sub-assembly 10. The key 12 is shown atop the segment carrier sub-assembly 14. FIG. 1B shows all the component parts. These include the segment carrier sub-assembly 14, the segments themselves 16, the segment fillers 18 and the external retaining rings 20. The segment carrier assembly has a series of grooves spaced along its circumference which accept the external retaining rings 20. The individual displacer segments 16 (made of polymer for insulation and heat resistance) are free to move laterally, along the long axis of the segment carrier assembly, and within a specified tolerance between two adjacent retaining rings 20. This tolerance accommodates the segments coefficient of thermal expansion, which differs from that of the displacer housing, throughout any temperatures it may encounter as the engine heats to operating temperature. The spacing of the retaining rings 20 also prevents the displacer segment from contacting the internal grooves of the displacer housing. This arrangement enables the segmented displacer to rotate freely within the confines of the displacer housing while maintaining a very close fit. A very close fit is necessary in order to minimize the volume of un-displaced working gas in the engine. All segments 16 employ a keyway 22, which corresponds to a key set into the segment carrier assembly. This aligns segments and provides a positive drive between the segments and the carrier. It also facilitates static and dynamic balancing of the segmented displacer. One displacer segment 16, the lowest in the picture, has segment fillers in place. Segment fillers 18 occupy the balancing holes in each segment 16 (the bulk of the segments shown do not have fillers inserted) which also minimizes the volume of un-displaced working gas in the engine.

FIG. 2 shows the assembly sequence, for the displacer segments 16, beginning with the displacer carrier sub-assembly with the first displacer segments 16 (#1/2), complete with six segment fillers 18, in place (FIG. 2A). The displacer segments 16 is secured by two external retaining rings, the one on the left of the displacer segments 16 being visible. FIG. 2B depict sequential displacer segments 16 secured in place along the carrier sub-assembly utilizing additional retaining rings. As each is assembled to the carrier, six segment fillers 18 are added. There is a relieved area at the left end of that displacer segments 16, necessary for placement of the retaining ring, but resulting in a small volume of un-displaced working gas. This is the only displacer segments 16 with this relieved area. Since any un-displaced working gas is to be avoided, an end cap, shown in the upper right hand corner of FIG. 1B, held in place with two threaded fasteners is utilized to achieve this purpose. The end cap in place on the fully assembled segmented displacer is not shown.

FIG. 3 shows the completed segmented rotary displacer. The steps, which show up prominently in the profile, increase the surface area of the hot and cold workspace in the interior of the displacer housing while minimizing any increase in overall inside diameter. Increasing the surface area improves heat transfer as the working gas is shuttled from the hot to the cold workspaces of the engine.

Figure 4A:
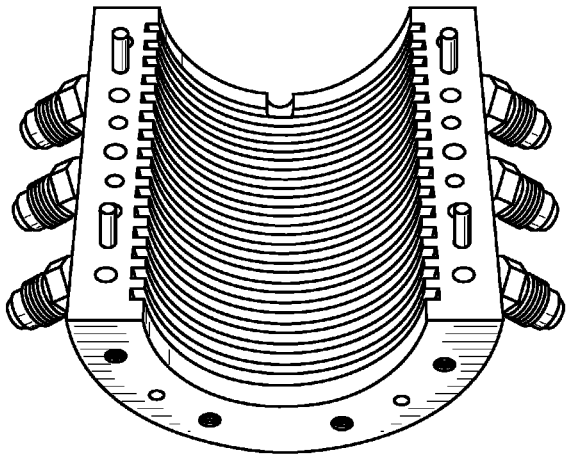
FIG. 4A shows the cold side of the displacer housing.
Figure 4B:
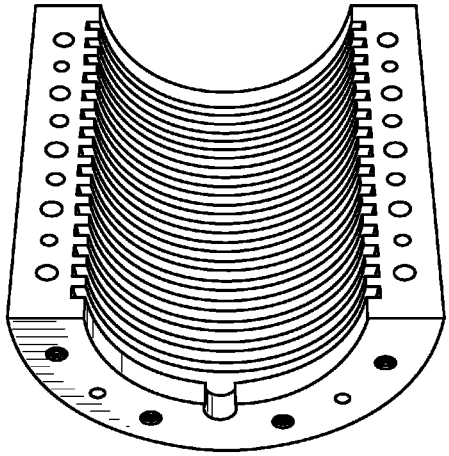
FIG. 4B shows the hot side of the displacer housing.

FIGS. 4A-4B show the hot and cold sides of the unassembled displacer housing. FIG. 4A illustrates one embodiment that has a cool side of the displacer housing that is liquid cooled and the hot side is heated directly by a flame from the combustion of a fuel gas. This configuration is suited for a high temperature difference engine. Other embodiments can use a heat source may be heated by any known source that provides heat to the hot side as there is not a singular manner through which the hot side may be heated. This embodiment is suited for a high temperature difference engine. However, other embodiment may be suited to a low temperature difference engines and include a hot side, physically identical to the cold side, but which employs the circulation of a heated liquid to transfer heat to the displacer housing. This configuration is suited to a low temperature difference engine. For manufacturing purposes and/or aesthetics, the hot side and the cold side may be physically identical.

FIG. 4A illustrates the left hand orientations of the cold side of the displacer housing. FIGS. 4B illustrates show the show the hot side hot side of the displacer housing. When assembled, the interior configuration is that of a stepped cylinder as opposed to a plain cylinder. The purpose of the steps is to increase the surface area of the hot and cold workspace in the interior of the displacer housing while minimizing any increase in overall inside diameter. Increasing the surface area improves heat transfer. The profile of the steps in the preceding figures depicts parallel sides with a flat top intersecting adjacent sides and the corner, which forms the intersections are chamfered. However, this profile may be modified depending on the specific device. For example, the profile can be configured as parallel sides with a flat top, the corners of which are shaped in the form of a radius as opposed to a chamfer. Further, this profile can be configured as parallel sides intersecting with a single radius tangent at the points of intersection. These steps, regardless of their profile, necessarily correspond to the steps in the profile of the segmented displacer.

The first displacer segment, in conjunction with the hot and cold sides of the displacer housing, collectively act as two rotary valves which direct hot (expanding) working gas exclusively to the hot port. Likewise, these components direct the cold (contracting) working gas exclusively to the cold port. From the hot port, the working gas is directed, via the hot cross over tube, to the hot side of the power piston cylinder. The power piston moves outwards under the influence of the hot expanding gas. The rotary valve inhibits the hot expanding gas from backing up through the cold workspace of the displacer housing while on its route to the power piston (were it not to do so, energy would be lost from the hot gas to the liquid cooled passages of the cold workspace). As the power piston approaches its rearmost movement, both rotary valves momentarily overlap in the open condition. This is shortly followed by the hot valve closing completely (and remaining so for about 180 degrees of rotation) and the cold valve opening fully (and likewise remaining open for about 180 degrees of rotation). The power piston then moves forward forcing the working gas through the cold port and into the cold workspace of the displacer housing.

Figure 5:
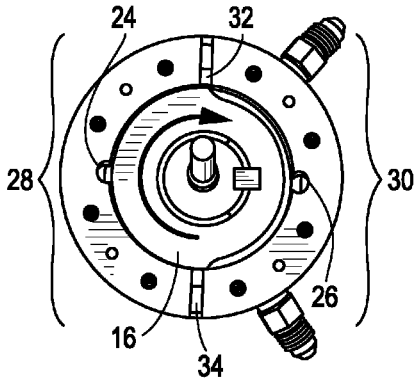
FIG. 5 is a picture which shows the right end of the assembled displacer housing with the first (#1/2) displacer segment in position. The picture identifies: the first displacer segment, the hot and cold ports, the hot and cold sides of the displacer housing, the upper and lower longitudinal seals, and the direction of rotation for the displacer itself.
Figure 6A:
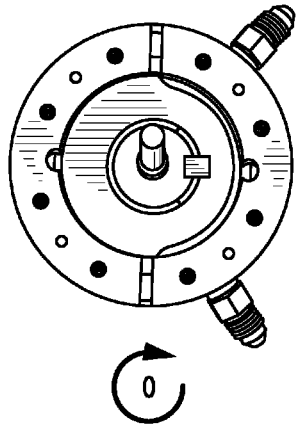
FIGS. 6A-6I shows the cycling of the valves through one complete revolution of the displacer. Each position is given a number inscribed by a circular arrowhead. The initial position is "0" (FIG. 6A) and position numbers progress, with the clockwise rotation of the displacer, in integers from "0" (FIG. 6A) to "12" (FIG. 6I) and then back again to "0", these are two points in a single complete revolution where both rotary valves are open.
Figure 6B:
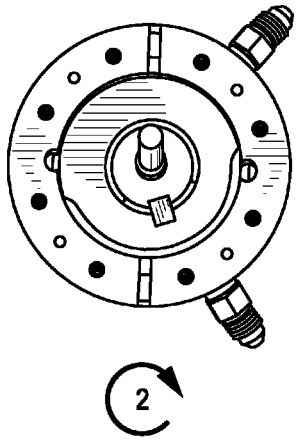
Figure 6C:
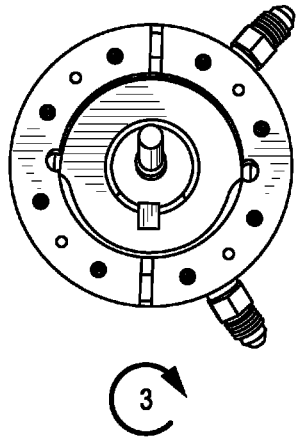
Figure 6D:
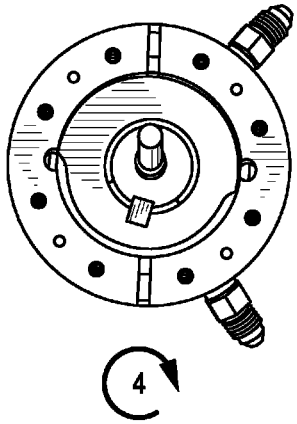
Figure 6E:
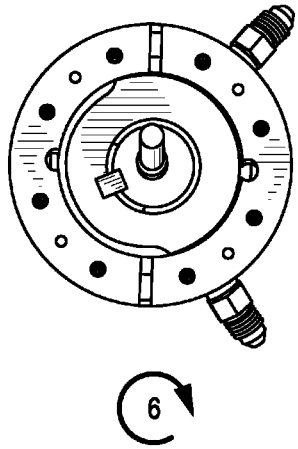
Figure 6F:
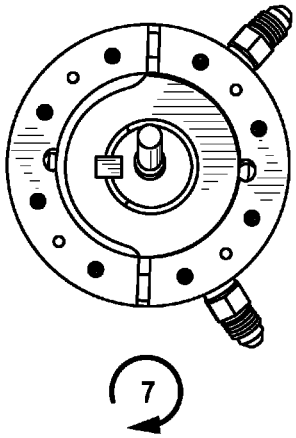
Figure 6G:
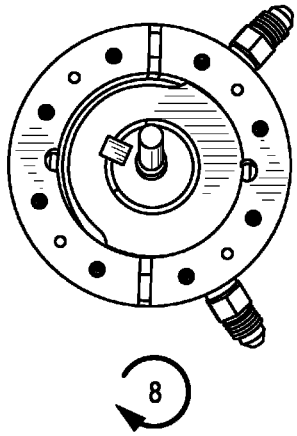
Figure 6H:
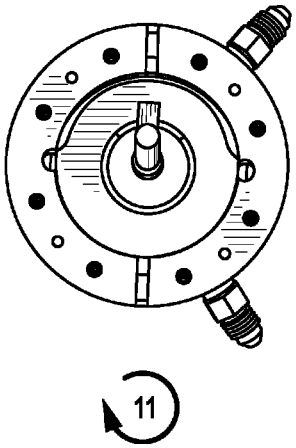
Figure 6I:
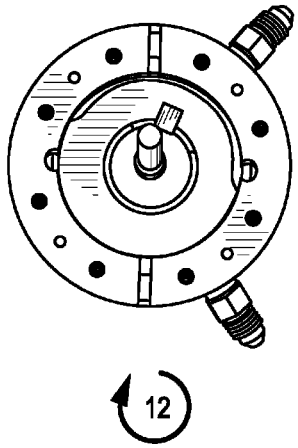

FIG. 5 shows the right end of the assembled displacer housing with the first displacer segment 16 (#1/2) displacer segment in position (the picture is oriented so that the cold side of the displacer housing is to the right). All engine components that attach to this end have been removed (e.g., right hand displacer housing end, hot cross over tube, power cylinder, power piston, etc.) as have the coolant manifolds so that the timing of the two rotary valves can be shown without obstruction. FIG. 5 identifies the first displacer segments 16, the hot port 24 and cold ports 26, the hot side 28 and cold side 30 of the displacer housing, the upper longitudinal seal 32 and lower longitudinal seal 34, and the direction of rotation for the displacer itself. The orientation of the displacer is such that the working gas is exposed exclusively to the cold workspace of the displacer. The rotary valves are positioned such that the hot valve is completely closed and the cold valve is completely open for about another 90 degrees of clockwise rotation. The upper and lower longitudinal seals minimize thermal conduction between the hot and cold sides of the displacer housing.

FIGS. 6A-6I shows the cycling of the valves through one complete revolution of the displacer. Each position is given a number inscribed by a circular arrowhead.

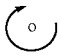

The initial position is "0" (FIG. 6A) and position numbers progress, with the clockwise rotation of the displacer, in integers from "0" (FIG. 6A) to "14" (not shown) and then back again to "0", (not shown) the initial position. Positions "3" (FIG. 6C) and "11" (FIG. 6H) display overlap, these are two points in a single complete revolution where both rotary valves are open.

Figure 7:
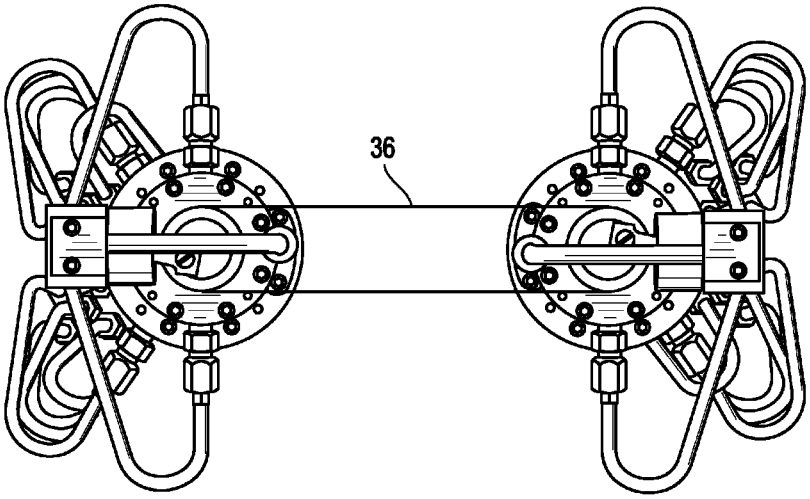
FIG. 7 is a picture showing the flexibility of the engine of the present invention in multi-cylinder configurations.

FIG. 7 shows the unique or novel characteristic of the engine of the present invention concerning its flexibility regarding multi-cylinder configurations connected y a timing belt 36.

Figure 8A:
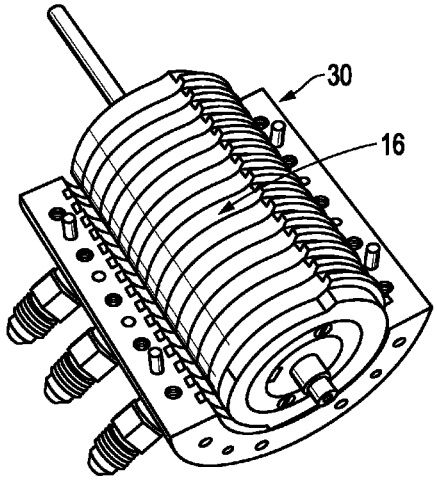
FIGS. 8A-8T show the assembly sequence of the engine of the present invention commencing with the rotary displacer assembly previously shown in FIG. 2.
Figure 8B:
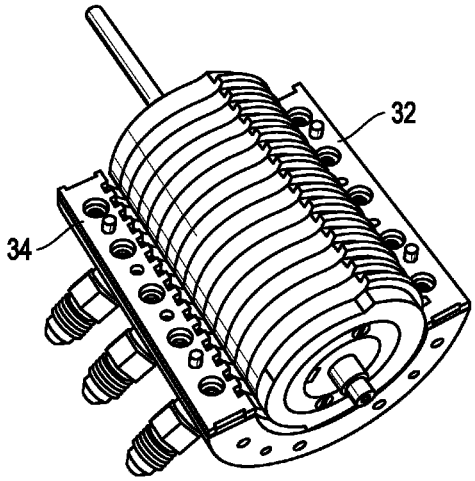
Figure 8C:
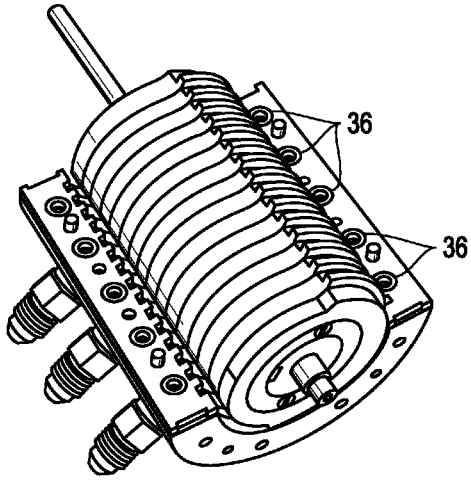
Figure 8D:
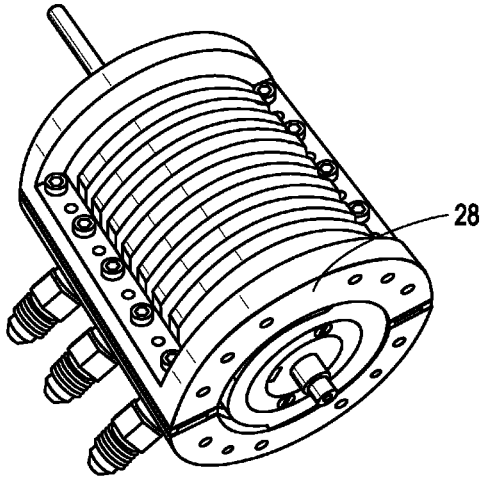
Figure 8E:
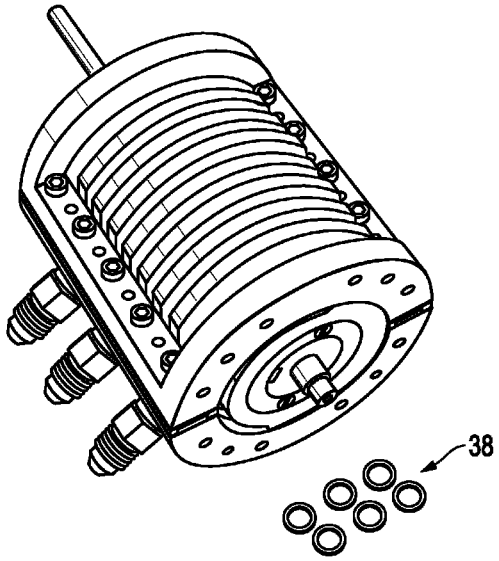
Figure 8F:
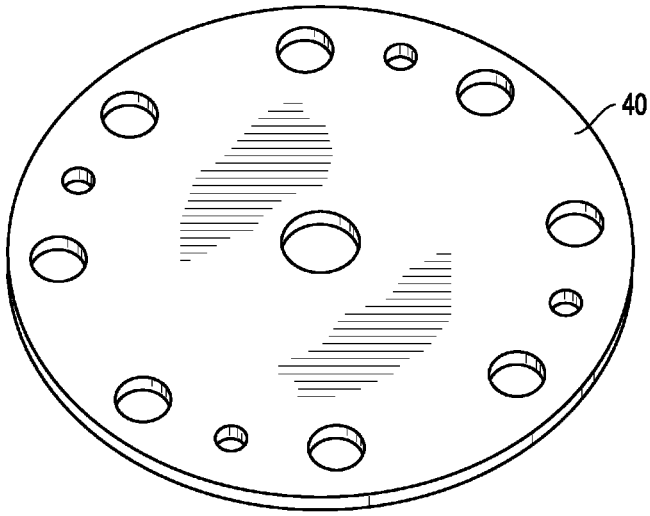
Figure 8G:
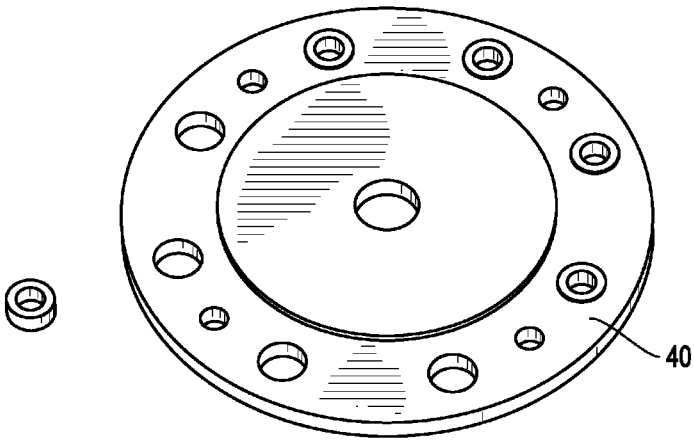
Figure 8H:
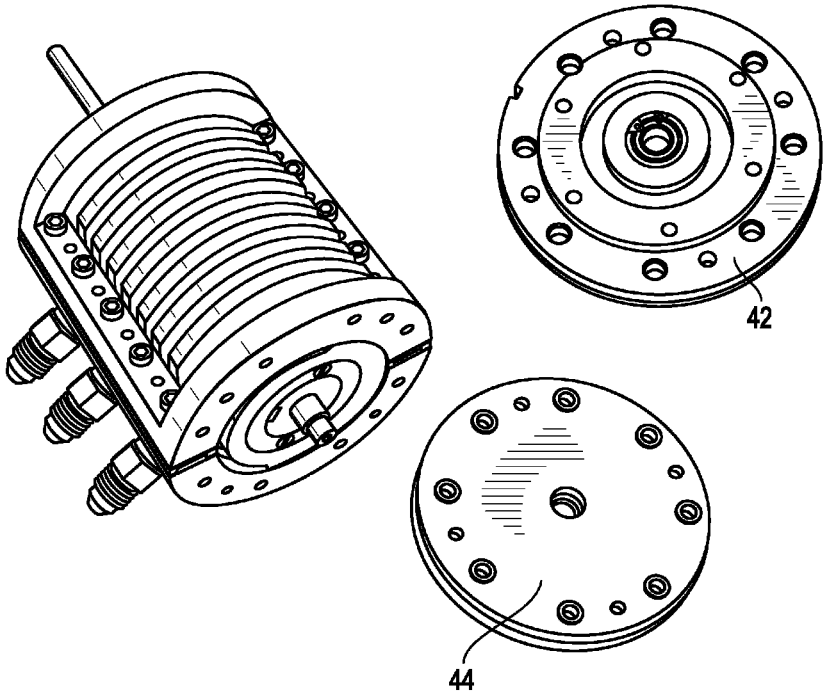
Figure 8I:
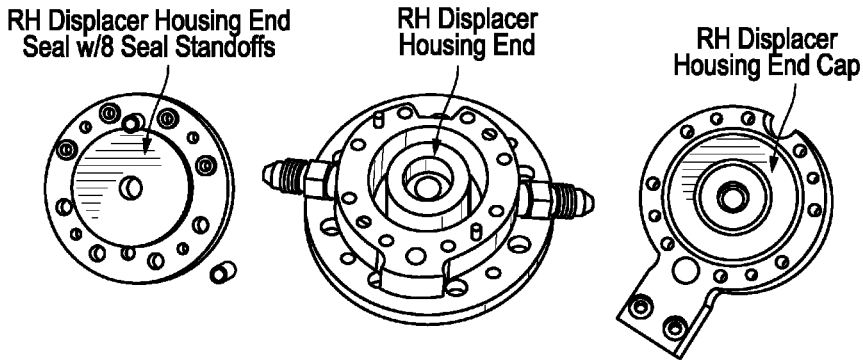
Figure 8J:
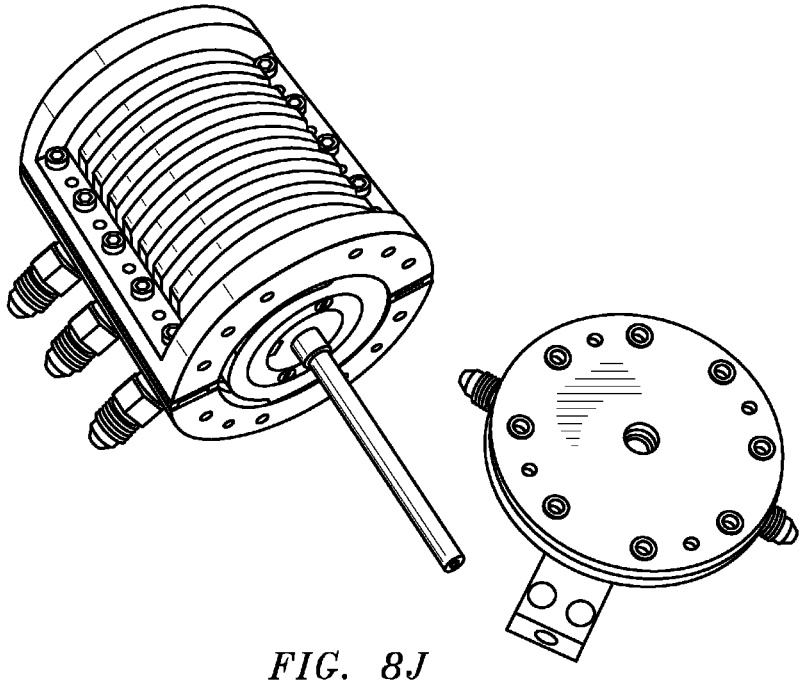
Figure 8K:
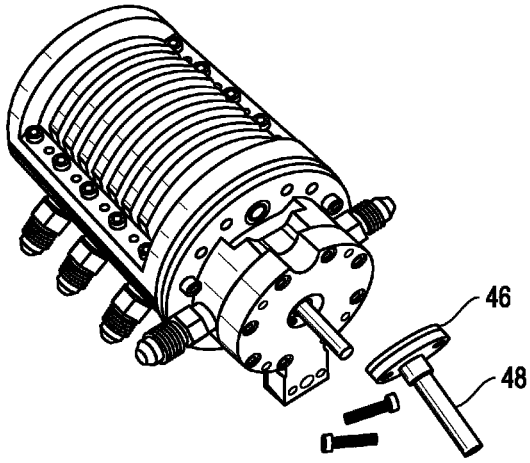
Figure 8L:
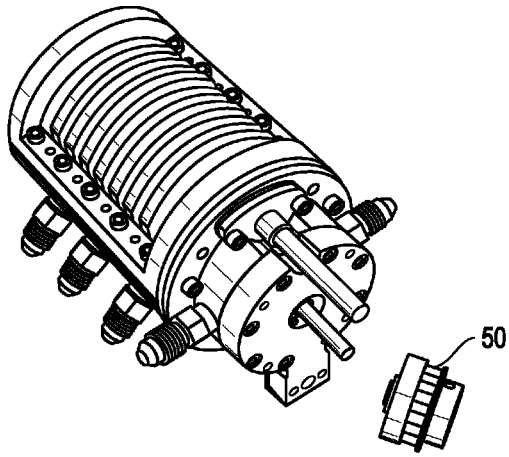
Figure 8M:
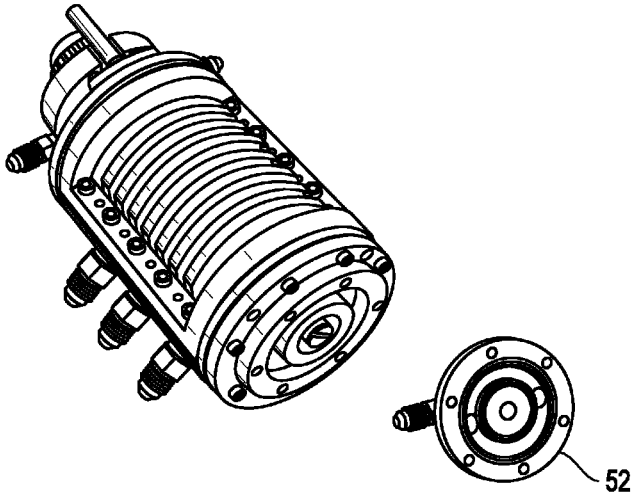
Figure 8N:
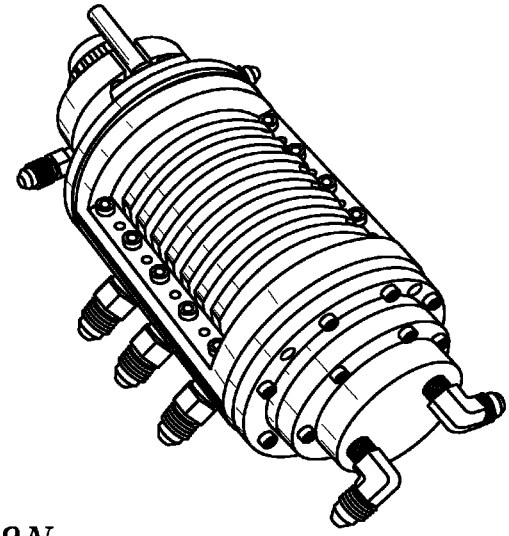
Figure 8O:
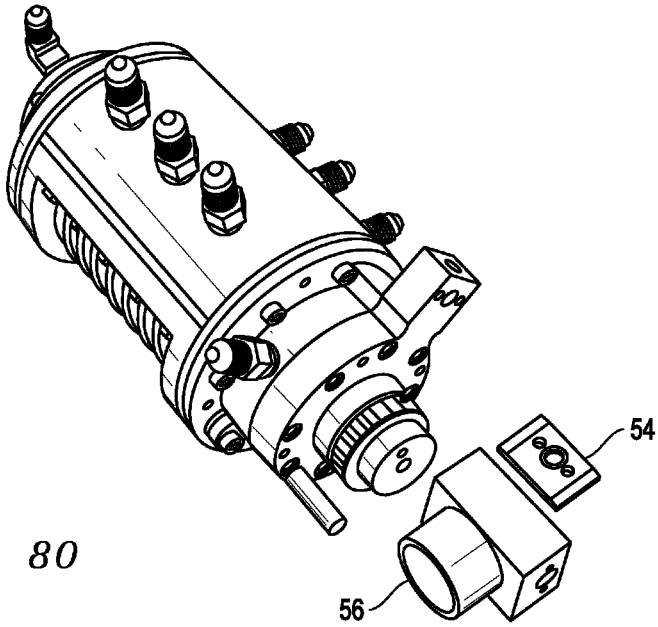
Figure 8P:
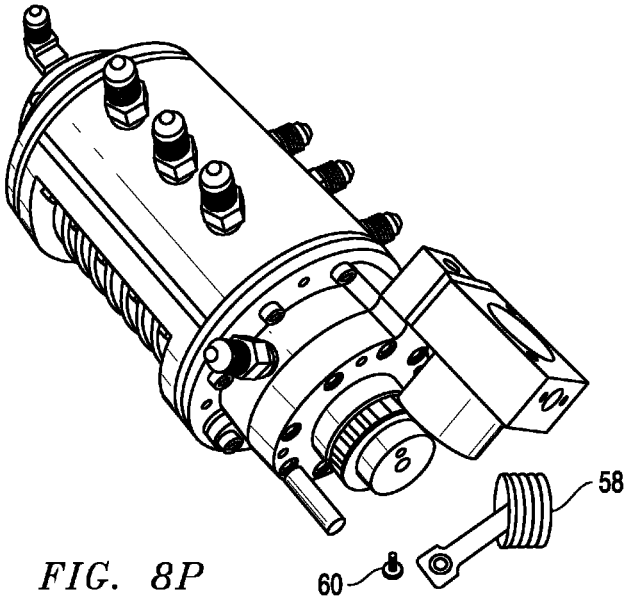
Figure 8Q:
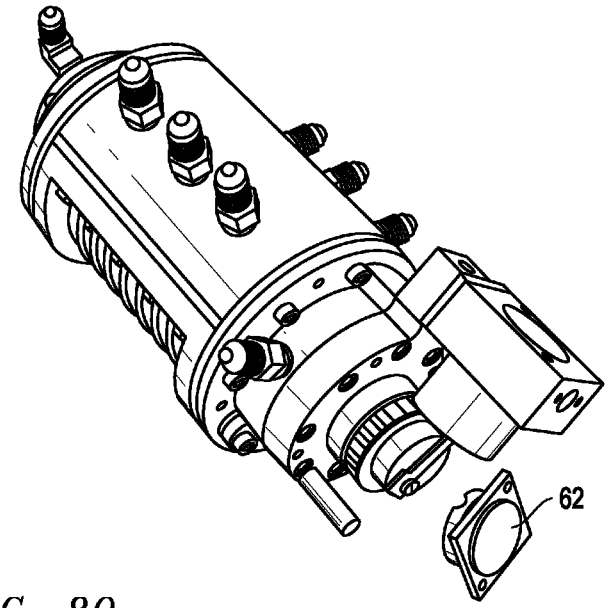
Figure 8R:
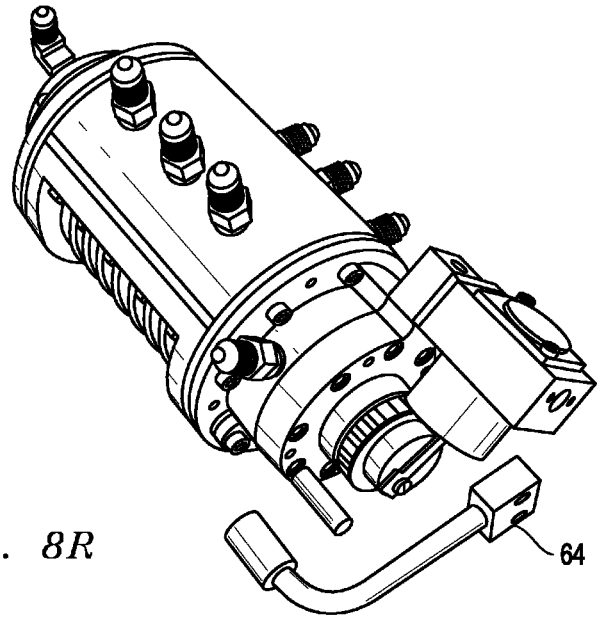
Figure 8S:
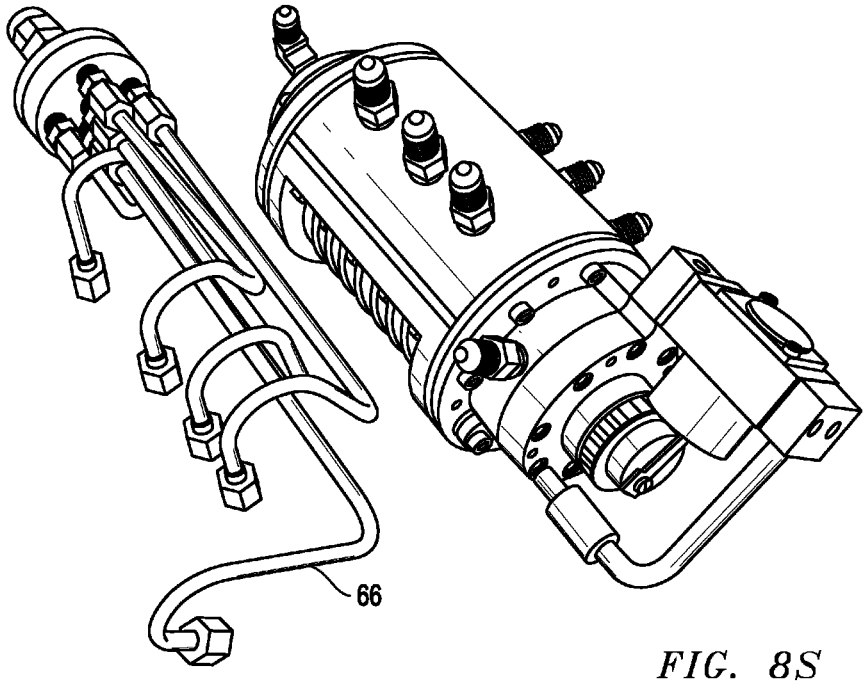
Figure 8T:
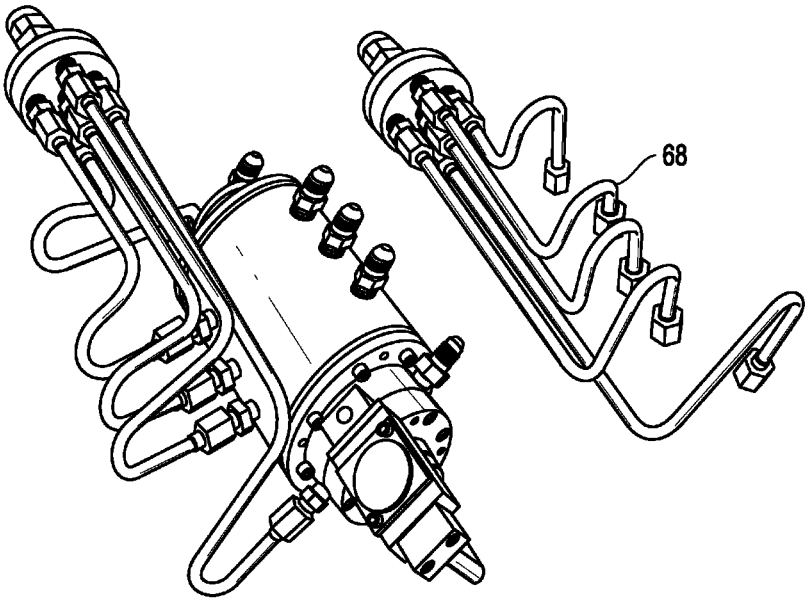

FIGS. 8A-8T shows the assembly sequence of the engine of the present invention commencing with the rotary displacer assembly previously shown in FIGS. 2 and 3. Miscellaneous standard parts e.g., o-rings, fasteners, etc. may be omitted in the figures. The FIGURES show the displacer housing, cold side 30 and the displacer segments 16. FIG. 8B also shows the lower longitudinal seal 34 and the upper longitudinal seal 32. FIG. 8C also shows the seal standoffs 36. FIG. 8D also shows the displacer housing hot side 28 hot side 28. FIGS. 8E shows the bearing shims 38. FIG. 8F also shows the LH displacer housing end seal 40 and FIG. 8G also shows the seal standoffs (8) 40. FIG. 8H also shows the LH displacer housing end 42 and the RH displacer housing end seal w/8 Seal Standoffs 44 and positioned by the housing in FIG. 8J. FIG. 8K also shows the hot cross over tube seal 46 and the hot cross over tube 48. FIG. 8I also shows the displacer pulley 50. FIG. 8M also shows the LH displacer housing end cap 52 and assembled in FIG. 8N. FIG. 8O also shows the power cylinder seal 54 and power cylinder 56. FIG. 8P also shows the Piston/Connecting Rod 58 and crank Pin 60. FIG. 8Q also shows the Power Cylinder 62. FIG. 8R also shows the hot cross over tube extension 64. FIG. 8S also shows the return coolant manifold 66 and the incoming coolant manifold 68 in FIG. 8T.

Figure 9:
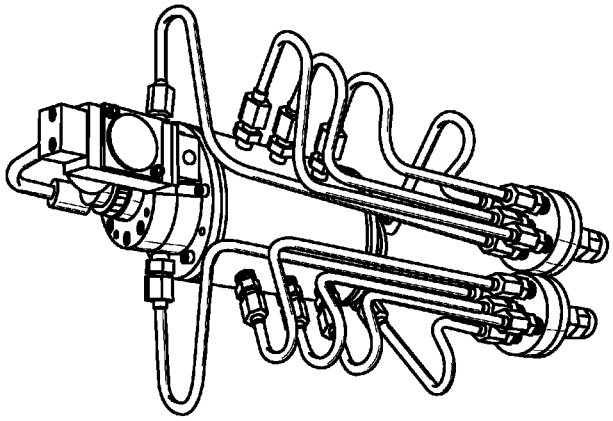
FIG. 9 shows the fully assembled engine of the present invention.

FIG. 9 shows the fully assembled engine of the present invention.

Figure 10:
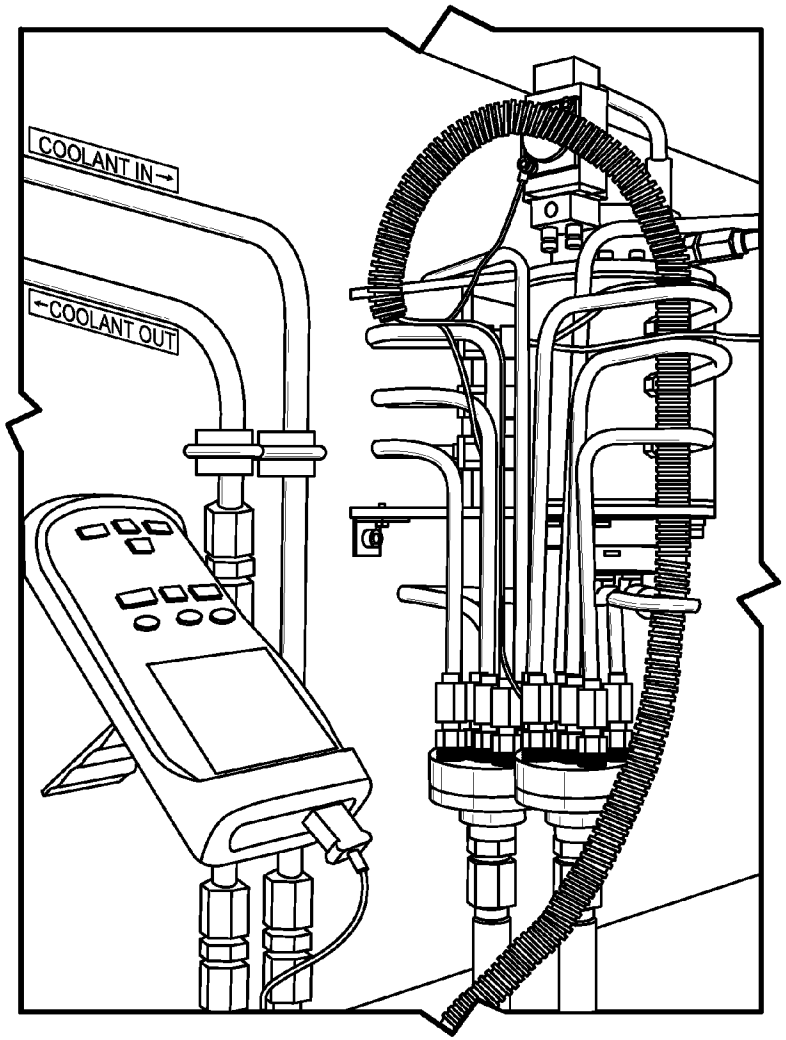
FIG. 10 shows the fully assembled engine of the present invention used in temperature distribution studies.

FIG. 10 shows the fully assembled engine of the present invention used in temperature distribution studies with the thermocouple located on the power cylinder.

Figure 11:
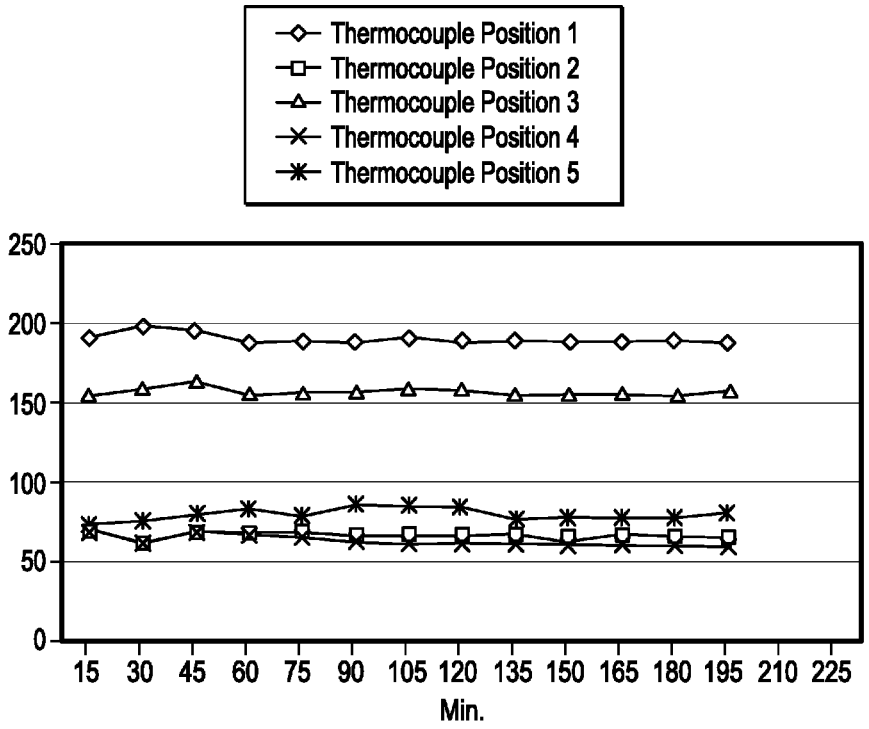
FIG. 11 is a graph of the representative temperature distribution at thermocouple locations 1 through 5 in ° F. by run time in minutes.

FIG. 11 is a graph of the representative temperature distribution at thermocouple locations 1 through 5 in ° F. by run time in minutes. These measure temperatures which are approximations of the actual on the inner surfaces of the hot side of the displacer housing. Since these thermocouples are attached to the edges of the hot displacer housing adjacent to the longitudinal insulating seals and the cold displacer housing, registered temperatures are somewhat lower than actual. What can be said is the actual temperature of the inner surfaces of the hot side of the displacer housing exceeds 190° F. Data from the upper thermocouple (at the displacer housing, hot side, top center) indicates temperatures that are consistently higher than those from the lower thermocouple (displacer housing, hot side, bottom center). These vary within a range of 30° F. to 39° F. (mean=33° F.). This observed variance is basically an artifact of the design of the gas burner used to heat the hot side of the displacer housing. From the initial cold start, the engine runs reliably once position 1, i.e., displacer housing, hot side, top center thermocouple registers 170° F. This occurs within 90 seconds of the cold start. Thermocouples at positions 2 displacer, i.e., housing right hand end, cold side and 4 displacer, i.e., housing left hand end, cold side, which measure the cold areas of the engine, are registering ambient room temperature (68° F.) at this time. Therefore, the engine will run with a $\delta t$ of approximately 102° F.

Table 2 illustrates a base set of specification to provide a point of reference and the skilled artisan will recognize that the individual values may be modified for the optimization of specific embodiments. For example, the bore and stroke maybe changes to provide a larger cylinder, the cycle volume and volume compression ratio may be adjusted to The segmented displacer may be of a variety of sizes and proportional so can the housing to accommodate the segmented displacer. For example, the segmented displacer may a major outside diameter that ranges from 0.25 to 5" (e.g., 2.450"); however, in certain applications the major outside diameter may be larger than 5". Similarly, the length may range from 0.25 to 8" (e.g., 3.866"); however, in certain applications the major outside diameter may be larger than 8".

The present invention uses a Polyetheretherketone (PEEK) polymer composition. Other theremoplastic polymer compositions may also be used including Polycarbonate (PC), Polyhydroxyalkanoates (PHAs), Polyketone (PK), Polyester, Polyetheretherketone (PEEK), Polyetherketoneketone (PEKK), Polyetherimide (PEI), Polyethersulfone (PES), Polysulfone, Polyethylenechlorinates (PEC), and Polyimide (PI) are merely examples of polymers that may be used.

TABLE 2

| Specifications | |
|---|---|
| Specifications | Comments |
| 1. Power Cylinder | |
| Bore: 1.000 in. | |
| Stroke: .625 in. | |
| Displacement (Piston Swept Volume): 0.491 in.$^3$ | |
| Material: 30400 Stainless Steel | CTE: $0.6 \times 10^{-5}$ in./in./° F. |
| 2. Cycle Volume, Maximum ($V_M$): 2.500 in.$^3$ | |
| 3. Cycle Volume, Minimum ($V_m$): 2.009 in.$^3$ | $V_m$ = Displacer Swept Volume |
| 4. Volume Compression Ratio (r) = $V_M/V_m$: 1.244 | r = Swept Volume Ratio; Comparable to Other Work |
| 5. Power Piston | |
| Material: Graphite | Comparable to Other Work |
| Advance: 90° | Comparable to Other Work |
| 6. Displacer Housing | |
| Major Inside Diameter: 2.500 | |
| Minor Inside Diameter: 2.250" | |
| Length: 3.878" | |
| Step Width × Height: .118" × .125" | Typical |
| Material: 30400 Stainless Steel | |
| 7. Segmented Displacer | |
| Major Outside Diameter: 2.450" | |
| 2.225" | |
| Length: 3.866" | |
| Step Width × Height: .110" × .100" | Typical |
| Material: Polyetheretherketone (PEEK) | CTE: $2.6 \times 10^{-5}$ in./in./° F.; Thermal Conductivity: 1.75 BTU - in./ft.$^2$ - hr. - ° F.; Heat Deflection Temperature: 320° F. @ 264 psi; Temp. Range: −20° F.-+400° F.; Hardness: Rockwell R126; Density: 81.2 lbs./ft.$^3$ |
| 8. Displacer Housing End and Longitudinal Insulating Seals | |
| Material: PEEK | |
| 9. Segment Fillers | |
| Material: Viton Foam Rubber | Temp. Range: −10° F.-+400° F.; Density: 3.5-6.5 lbs./ft.$^3$; Structure: Closed Cell |
| 10. O-Rings (various DASH #s) | |
| Material: Buna-N | Temp. Range: −65° F.-275° F. |
| 11. Fasteners (various sizes) | |
| Material: 316/416 Stainless Steel | |

It is contemplated that any embodiment discussed in this specification can be implemented with respect to any method, kit, reagent, or composition of the invention, and vice versa. Furthermore, compositions of the invention can be used to achieve methods of the invention.

It will be understood that particular embodiments described herein are shown by way of illustration and not as limitations of the invention. The principal features of this invention can be employed in various embodiments without departing from the scope of the invention. Those skilled in the art will recognize, or be able to ascertain using no more than routine experimentation, numerous equivalents to the specific procedures described herein. Such equivalents are considered to be within the scope of this invention and are covered by the claims.

All publications and patent applications mentioned in the specification are indicative of the level of skill of those skilled in the art to which this invention pertains. All publications and patent applications are herein incorporated by reference to the same extent as if each individual publication or patent application was specifically and individually indicated to be incorporated by reference.

The use of the word "a" or "an" when used in conjunction with the term "comprising" in the claims and/or the specification may mean "one," but it is also consistent with the meaning of "one or more," "at least one," and "one or more than one." The use of the term "or" in the claims is used to mean "and/or" unless explicitly indicated to refer to alternatives only or the alternatives are mutually exclusive, although the disclosure supports a definition that refers to only alternatives and "and/or." Throughout this application, the term "about" is used to indicate that a value includes the inherent variation of error for the device, the method being employed to determine the value, or the variation that exists among the study subjects.

As used in this specification and claim(s), the words "comprising" (and any form of comprising, such as "comprise" and "comprises"), "having" (and any form of having, such as "have" and "has"), "including" (and any form of including, such as "includes" and "include") or "containing" (and any form of containing, such as "contains" and "contain") are inclusive or open-ended and do not exclude additional, unrecited elements or method steps.

The term "or combinations thereof" as used herein refers to all permutations and combinations of the listed items preceding the term. For example, "A, B, C, or combinations thereof" is intended to include at least one of: A, B, C, AB, AC, BC, or ABC, and if order is important in a particular context, also BA, CA, CB, CBA, BCA, ACB, BAC, or CAB. Continuing with this example, expressly included are combinations that contain repeats of one or more item or term, such as BB, AAA, MB, BBC, AAABCCCC, CBBAAA, CABABB, and so forth. The skilled artisan will understand that typically there is no limit on the number of items or terms in any combination, unless otherwise apparent from the context.

All of the compositions and/or methods disclosed and claimed herein can be made and executed without undue experimentation in light of the present disclosure. While the compositions and methods of this invention have been described in terms of preferred embodiments, it will be apparent to those of skill in the art that variations may be applied to the compositions and/or methods and in the steps or in the sequence of steps of the method described herein without departing from the concept, spirit and scope of the invention. All such similar substitutes and modifications apparent to those skilled in the art are deemed to be within the spirit, scope and concept of the invention as defined by the appended claims.

What is claimed is:

1. An engine employing a segmented, rotary displacer for producing mechanical energy from a heat source comprising:

an engine housing comprising a hot displacer side housing that mates to a cold displacer side housing;

one or more hot interior channels located within the hot displacer side housing;

one or more cold interior channels located within the cold displacer side housing in communication with at least one coolant inlet and one coolant outlet;

a polymer insulating housing seal positioned between the hot displacer side housing and the cold displacer side housing to thermally isolate the hot displacer side housing from the cold displacer side housing;

an interior toroidal cavity formed between the hot displacer side housing and the cold displacer side housing; and a series of coaxial grooves formed within a circumference of the interior toroidal cavity;

a first end plate insulating polymer seal that mates between and thermally isolates a first end of the engine housing from a first end plate cap;

a hot passage extending through the first end plate cap and into the hot displacer side housing;

a cold passage extending through the first end plate cap and into the cold displacer side housing, wherein the hot passage is positioned transversely to the cold passage;

a second end plate insulating polymer seal that mates between and thermally isolates a second end of the engine housing from a second end plate cap;

a rotor shaft rotatably positioned in the interior toroidal cavity, wherein the rotor shaft acts as an internal flywheel;

a first polymer displacer segment connected to the rotor shaft at the first end of the engine housing adjacent to the first end plate cap, wherein the first polymer displacer segment comprises a generally circular segment with a first displacer segment portion having a first radius that extends about a first half of the generally circular segment, a second displacer segment portion with a second radius that extends about a second half of the generally circular segment such that the second radius is greater than the first radius, a chamber portion formed by the difference between the first radius and the second radius, and a coaxial groove about the second displacer segment portion that mates to one of the grooves of the series of coaxial grooves to increase the surface area and augment heat transfer, wherein the rotation of the rotor shaft rotates the first polymer displacer segment to position the first displacer segment portion to alternately obscure the hot passage and the cold passage;

at least 3 generally circular polymer displacer segments each connected to the rotor shaft and positioned adjacent to the first polymer displacer segment, wherein each of the at least 3 generally circular polymer displacer segments comprise a generally circular segment with a first displacer segment portion having a first radius that extends about a first half of the generally circular segment, a second displacer segment portion with a second radius that extends about a second half of the generally circular segment such that the second radius is greater than the first radius, a chamber portion formed by the difference between the first radius and the second radius, and a coaxial groove about the second displacer segment portion that mates to one of the grooves of the series of coaxial grooves to increase the surface area and augment heat transfer, one or more holes positioned in the second displacer segment portion, and one or more plugs positioned in the one or more holes, wherein the chamber portion of the at least 3 generally circular polymer displacer segments align with the chamber portion of the first polymer displacer segment to form an aligned chamber portion;

wherein the rotation of the rotor shaft rotates the first polymer displacer segment the at least 3 generally circular polymer displacer segments such that the first polymer displacer segment to position the first displacer segment portion to alternately obscure the hot passage and the cold passage and the aligned chamber portion alternately contacts the hot passage and the cold passage.

2. The rotary engine of claim 1, further comprises one or more connections positioned on the outside of the engine housing and in communication with the one or more hot interior channels and the one or more cold interior channels.

3. The rotary engine of claim 1, wherein each of the at least 3 generally circular polymer displacer segments are arranged in a laterally spaced step pattern.

4. The rotary engine of claim 1, wherein the one or more plugs are one or more segment fillers.

5. The rotary engine of claim 1, wherein the at least 3 generally circular polymer displacer segments are separated by retainer clips.

6. The rotary engine of claim 1, further comprises a rotor control mechanism for regulating angular orientation of the at least 3 generally circular polymer displacer segments.

7. The rotary engine of claim 1, wherein the first polymer displacer segment does not contact the first end plate and regulates the gas flow at the hot passage and the cold passage.

8. The rotary engine of claim 1, wherein each of the at least 3 generally circular polymer displacer segments individually comprising a front and a rear planar, parallel side surfaces each perpendicular to the central housing axis and in sealed rotational engagement with the engine housing wherein the front and rear planar, parallel side surfaces terminate in a top surface that is perpendicular to the side surfaces with a chamfer at the points of intersection; perpendicular to the side surfaces with a radius at the points of intersection; or part or all of a single radius tangent or nearly tangent at the points of intersection.

9. A method of making a rotary engine comprising:

providing an engine housing comprising a hot displacer side housing that mates to a cold displacer side housing;

one or more hot interior channels located within the hot displacer side housing;

one or more cold interior channels located within the cold displacer side housing in communication with at least one inlet and one outlet;

an interior toroidal cavity formed in the engine housing; and a series of coaxial grooves formed within a circumference of the interior toroidal cavity;

positioning a polymer insulating seal positioned between the hot displacer side housing and the cold displacer side housing to isolate the hot displacer side housing from the cold displacer side housing wherein there is no thermal conductivity between the hot displacer side housing and the cold displacer side housing;

providing a rotor shaft, wherein the rotor shaft acts as an internal flywheel;

connecting a first polymer displacer segments to the rotor shaft at a first end, wherein the first polymer displacer segment comprises a generally circular segment with a first displacer segment portion having a first radius that extends about a first half of the generally circular segment, a second displacer segment portion with a second radius that extends about a second half of the generally circular segment such that the second radius is greater than the first radius, a chamber portion formed by the difference between the first radius and the second radius, and a coaxial groove about the second displacer segment portion that mates to one of the grooves of the series of coaxial grooves to increase the surface area and augment heat transfer, wherein the rotation of the rotor shaft rotates the first polymer displacer segment to position the first displacer segment portion to alternately obscure the hot passage and the cold passage;

connecting at least 3 generally circular polymer displacer segments to the rotor shaft adjacent to the first polymer displacer segments with a retainer ring, wherein each of the at least 3 generally circular polymer displacer segments comprise a generally circular segment with a first displacer segment portion having a first radius that extends about a first half of the generally circular segment, a second displacer segment portion with a second radius that extends about a second half of the generally circular segment such that the second radius is greater than the first radius, a chamber portion formed by the difference between the first radius and the second radius, and a coaxial groove about the second displacer segment portion that mates to one of the grooves of the series of coaxial grooves to increase the surface area and augment heat transfer, one or more holes positioned in the second displacer segment portion, and one or more plugs positioned in the one or more holes, wherein the chamber portion of the at least 3 generally circular polymer displacer segments align with the chamber portion of the first polymer displacer segment to form an aligned chamber portion;

positioning the rotor shaft into the interior toroidal cavity;

inserting the coaxial groove about the second displacer segment portion into the series of coaxial grooves in the interior toroidal cavity to increase the surface area and augment heat transfer;

positioning a first end plate insulating polymer seal between and isolating a first end of the engine housing from a first end plate cap, wherein the first end plate cap comprises a hot passage extending through the first end plate cap and into the hot displacer side housing and a cold passage extending through the first end plate cap and into the cold displacer side housing, wherein the hot passage is positioned transversely to the cold passage, wherein the first polymer displacer segment is adjacent to the first end plate cap to alternately obscure the hot port and the cold port as the rotor shaft and the first polymer displacer segment rotates and the rotation of the rotor shaft rotates the chamber portion to alternately block the hot port and the cold port;

securing the first end plate cap to the first end of the engine housing; and positioning a second end plate insulating polymer seal between and isolating a second end of the engine housing from a second end plate cap; and securing the second end plate cap to the second end of the engine housing.

10. The method of claim 9, further comprising the step of connecting a cold gas port, and a hot gas port positioned on the outside of the engine housing.

11. The method of claim 9, wherein each of the at least 3 generally circular polymer displacer segments are laterally spaced along a length of the rotor shaft.

12. The method of claim 9, wherein the 3 or more displacer segments are separated by retainer clips.

13. The method of claim 9, further comprises regulating angular reciprocation of the displacer segment with a control mechanism.

14. The method of claim 9, wherein the first polymer displacer segment does not contact the first end plate and regulates the gas flow at the hot passage and the cold passage.

15. The method of claim 9, wherein the 3 or more displacer segments individually comprising a front and a rear planar, parallel side surfaces each perpendicular to the central housing axis and in sealed rotational engagement with the engine housing wherein the front and rear planar, parallel side surfaces terminate in a top surface that is perpendicular to the side surfaces with a chamfer at the points of intersection; perpendicular to the side surfaces with a radius at the points of intersection; or part or all of a single radius tangent or nearly tangent at the points of intersection.

16. A multi-cylinder rotary engine comprising:

an engine comprising 2 or more cylinders, wherein each of the 2 or more cylinders comprise a first engine housing comprising a hot displacer side housing that mates to a cold displacer side housing;

one or more hot interior channels located within the hot displacer side housing;

one or more cold interior channels located within the cold displacer side housing in communication with at least one coolant inlet and one coolant outlet;

a polymer insulating housing seal positioned between the hot displacer side housing and the cold displacer side housing to thermally isolate the hot displacer side housing from the cold displacer side housing;

an interior toroidal cavity formed between the hot displacer side housing and the cold displacer side housing; and a series of coaxial grooves formed within a circumference of the interior toroidal cavity;

a first end plate insulating polymer seal that mates between and thermally isolates a first end of the engine housing from a first end plate cap;

a hot passage extending through the first end plate cap and into the hot displacer side housing;

a cold passage extending through the first end plate cap and into the cold displacer side housing, wherein the hot passage is positioned transversely to the cold passage;

a second end plate insulating polymer seal that mates between and thermally isolates a second end of the engine housing from a second end plate cap;

a rotor shaft rotatably positioned in the interior toroidal cavity, wherein the rotor shaft acts as an internal flywheel;

a first polymer displacer segment connected to the rotor shaft at the first end of the engine housing adjacent to the first end plate cap, wherein the first polymer displacer segment comprises a generally circular segment with a first displacer segment portion having a first radius that extends about a first half of the generally circular segment, a second displacer segment portion with a second radius that extends about a second half of the generally circular segment such that the second radius is greater than the first radius, a chamber portion formed by the difference between the first radius and the second radius, and a coaxial groove about the second displacer segment portion that mates to one of the grooves of the series of coaxial grooves to increase the surface area and augment heat transfer, wherein the rotation of the rotor shaft rotates the first polymer displacer segment to position the first displacer segment portion to alternately obscure the hot passage and the cold passage;

at least 3 generally circular polymer displacer segments each connected to the rotor shaft and positioned adjacent to the first polymer displacer segment, wherein each of the at least 3 generally circular polymer displacer segments comprise a generally circular segment with a first displacer segment portion having a first radius that extends about a first half of the generally circular segment, a second displacer segment portion with a second radius that extends about a second half of the generally circular segment such that the second radius is greater than the first radius, a chamber portion formed by the difference between the first radius and the second radius, and a coaxial groove about the second displacer segment portion that mates to one of the grooves of the series of coaxial grooves to increase the surface area and augment heat transfer, one or more holes positioned in the second displacer segment portion, and one or more plugs positioned in the one or more holes, wherein the chamber portion of the at least 3 generally circular polymer displacer segments align with the chamber portion of the first polymer displacer segment to form an aligned chamber portion;

wherein the rotation of the rotor shaft rotates the first polymer displacer segment the at least 3 generally circular polymer displacer segments such that the first polymer displacer segment to position the first displacer segment portion to alternately obscure the hot passage and the cold passage and the aligned chamber portion alternately contacts the hot passage and the cold passage; and a belt to connect the rotor shaft of each of the first engine housing of the 2 or more cylinders.

17. A method of making a multi-cylinder rotary engine comprising:

providing a rotary engine comprising 2 or more cylinders, wherein each of the 2 or more cylinders comprise an engine housing comprising providing an engine housing comprising a hot displacer side housing that mates to a cold displacer side housing;

an interior toroidal cavity formed in the engine housing; and a series of coaxial grooves formed within a circumference of the interior toroidal cavity;

one or more hot interior channels located within the hot displacer side housing;

one or more cold interior channels located within the cold displacer side housing in communication with at least one coolant inlet and one coolant outlet;

positioning a polymer insulating seal positioned between the hot displacer side housing and the cold displacer side housing to isolate the hot displacer side housing from the cold displacer side housing wherein there is no thermal conductivity between the hot displacer side housing and the cold displacer side housing;

providing a rotor shaft, wherein the rotor shaft acts as an internal flywheel;

connecting a first polymer displacer segment to the rotor shaft at a first end;

positioning at least 3 generally circular polymer displacer segments on the rotor shaft adjacent to the first polymer displacer segment, wherein each of the at least 3 generally circular polymer displacer segments comprise a first displacer segment portion that extends about a half of a circumference of the generally circular segment with a first radius; and a second displacer segment portion that extends about a second half of the circumference of the generally circular segment with a second radius that is greater than the first radius; a coaxial groove about the circumference of the second placement segment portion to increase the surface area and augment heat transfer; one or more balance holes positioned in the second placement segment portion;

positioning one or more weighted balance plugs into the one or more balance holes to provide an internal counter balance for each of the at least 3 generally circular polymer displacer segments;

a chamber portion formed by the difference between the first radius and the second radius;

connecting each of the at least 3 generally circular polymer displacer segments to the rotor shaft by a retainer ring;

positioning the rotor shaft into the interior toroidal cavity;

positioning the coaxial groove about the circumference of the second placement segment portion into the series of coaxial grooves;

positioning a second end plate insulating polymer seal between and isolating a second end of the engine housing from a second end plate cap;

securing the second end plate cap to the second end of the engine housing;

positioning a first end plate insulating polymer seal between and isolating a first end of the engine housing from a first end plate cap, wherein the first end plate cap comprises a hot port extending through the first end plate cap and into the hot displacer side housing and a cold port extending through the first end plate cap and into the cold displacer side housing, wherein the hot port is positioned transversely to the cold port;

securing the first end plate cap to the first end of the engine housing; and wherein the first polymer displacer segment is adjacent to the first end plate cap to alternately block the hot port and the cold port as the rotor shaft and the first polymer displacer segment rotates and the rotation of the rotor shaft rotates the chamber portion to alternately block and unblock the hot port and the cold port; and connecting a belt to each of the rotor shafts.

* * * * *